US005569347A

United States Patent [19]

Obata et al.

[11] Patent Number: 5,569,347

[45] Date of Patent: Oct. 29, 1996

[54] THERMAL TRANSFER MATERIAL

[75] Inventors: Yoshiyuki Obata; Hideki Suematsu; Manabu Ikemoto, all of Osaka, Japan

[73] Assignee: Fujicopian Co., Ltd., Osaka, Japan

[21] Appl. No.: 359,416

[22] Filed: Dec. 20, 1994

[30] Foreign Application Priority Data

Dec. 21, 1993 [JP] Japan ..... 5-322330

[51] Int. Cl.$^6$ ..... B41M 5/34

[52] U.S. Cl. ..... 156/235; 156/230; 156/240; 428/195; 428/212; 428/213; 428/215; 428/216; 428/304.4; 428/332; 428/336; 428/337; 428/341; 428/484; 428/488.1; 428/913; 428/914

[58] Field of Search ..... 428/195, 212, 428/213, 215, 216, 332, 336, 337, 484, 488.1, 913, 914, 304.4, 341; 156/230, 235, 240

[56] References Cited

U.S. PATENT DOCUMENTS 4,503,095 3/1985 Seto et al. .
5,053,267 10/1991 Ide et al. .

FOREIGN PATENT DOCUMENTS 02521488 8/1983 France ..... B41M 5/18
02069160 11/1989 United Kingdom ..... B41M 5/18

*Primary Examiner*—Bruce H. Hess
*Attorney, Agent, or Firm*—Fish & Neave

[57] ABSTRACT

A thermal transfer material is disclosed which is useful in a method for forming a color image comprising selectively melt-transferring at least one of a yellow heat-meltable ink layer, a magenta heat-meltable ink layer and a cyan heat-meltable ink layer onto a receptor having a multiplicity of micropores in the surface layer thereof to enter each ink in a molten state into the micropores, thereby forming a color image comprising at least one of (A) at least one color region of single color of yellow, magenta and cyan, and (B) at least one color region developed on the basis of subtractive color mixture of at least two of yellow, magenta and cyan. The thermal transfer material comprises at least one of a yellow heat-meltable ink layer, a magenta heat-meltable ink layer and a cyan heat-meltable ink layer provided on a foundation or foundations, each ink layer having a melt viscosity of 20 to 200 cps/90° C. and a coating amount of 0.5 to 2.5 g/m$^2$, the foundation having a thickness of 1.0 to 4.5 μm and the thermal transfer material having an overall thickness of 2.5 to 7.0 μm. The thermal transfer material gives color images excellent in both color reproducibility and resolution.

8 Claims, 3 Drawing Sheets

THERMAL TRANSFER MATERIAL

BACKGROUND OF THE INVENTION

The present invention relates to a thermal transfer material for use in a method for forming a color image, particularly a multi-color or full-color image by melt-transferring heat-meltable inks onto a receptor having a multiplicity of micropores in the surface layer thereof.

Heretofore there has been proposed a method for forming a multi-color image on a receptor having a multiplicity of micropores in the surface layer thereof wherein a yellow heat-meltable ink layer, a magenta heat-meltable ink layer and a cyan heat-meltable ink layer are selectively melt-transferred in succession onto the receptor to enter each ink in a molten state into the micropores, thereby forming a multi-color image on the basis of subtractive color mixture (Institute of Television Engineers of Japan (ITE) Technical Report, Vol. 17, No. 27, pages 19 to 24 (May, 1993).

The color image formation method is explained by referring to FIGS. 1 and 2. In FIG. 1, numeral 1 denotes a thermal transfer material wherein heat-meltable ink layers 3 for respective colors are provided on a foundation 2. Numeral 4 denotes a receptor wherein a multiplicity of micropores 5 are formed in the surface layer thereof (hereinafter referred to as "porous surface receptor" in some cases). The diameter and depth of the micropores 5 are on the order of micrometers. In the porous surface receptor 4 shown in FIG. 1, the micropores 5 are pictured regularly but actual micropores are irregular.

The thermal transfer material 1 is superimposed onto the receptor 4. The resulting assembly is heated by means of a thermal head T (in FIG. 1, only one heating element is shown) with being pressed against a platen P, whereby the ink in a heated portion is melted and the molten ink is entered into micropores 5 mainly by capillary action. When the thermal transfer material 1 is separated from the receptor 4, there is obtained the receptor 4 having a color image wherein the ink 6 is contained in the micropores 5 in a portion of the receptor 4 which corresponds to the activated heating elements of the thermal head T, as shown in FIG. 2.

The development of a color, for example, red, on the basis of subtractive color mixture can be achieved by first entering a yellow ink 6Y into micropores 5 and then entering a magenta ink 6M into the micropores 5, thereby superimposing both inks in the respective micropores 5, as shown in FIG. 3. Similarly, green is obtained by a combination of yellow ink and cyan ink; blue is obtained by a combination of magenta ink and cyan ink; and black is obtained by a combination of yellow ink, magenta ink and cyan ink.

In the color image formation method, the density of each color is determined by the amount of the ink for the color contained in the micropores of the receptor. Therefore the method has an advantage that the representation of gradation is possible in every picture element by controlling the amount of each ink heated in transfer.

However, research has not been fully made on the thermal transfer material for use in the aforesaid color image formation method. The present inventors research has revealed various problems including the difficulty in entering a predetermined amount of an ink into the micropores.

A serious problem is that as shown in FIG. 5, there occurs a phenomenon that the ink transferred onto the receptor is not sure to get into the micropores 5, hence, a portion of the ink remains in the form of a layer on the surface of the receptor 4 (hereinafter referred to as "excess transfer").

When such an excess transfer, which means that a predetermined amount of the ink does not get into the micropores occurs, a good gradation and a desired subtractive color mixture are not achieved, resulting in a poor color reproducibility, and the ink is not transferred in the same area as that of the heating element, resulting in a decrease in resolution.

In view of the above, an object of the present invention is to provide a thermal transfer material useful for the foregoing color image formation method.

Another object of the present invention is to provide a thermal transfer material capable of forming a multi-color or full-color image excellent in gradation, color reproducibility and resolution.

These and other objects of the present invention will become apparent from the description hereinafter.

SUMMARY OF THE INVENTION

The present invention provides a thermal transfer material for use in a method for forming a color image comprising selectively melt-transferring at least one of a yellow heat-meltable ink layer, a magenta heat-meltable ink layer and a cyan heat-meltable ink layer onto a receptor having a multiplicity of micropores in the surface layer thereof to enter each ink in a molten state into the micropores, thereby forming a color image comprising at least one of (A) at least one color region of single color of yellow, magenta and cyan, and (B) at least one color region developed on the basis of subtractive color mixture of at least two of yellow, magenta and cyan, the thermal transfer material comprising a foundation and at least one of a yellow heat-meltable ink layer, a magenta heat-meltable ink layer and a cyan heat-meltable ink layer provided on the foundation, each ink layer having a melt viscosity of 20 to 200 cps/90° C. and a coating amount of 0.5 to 2.5 g/m$^2$, the foundation having a thickness of 1.0 to 4.5 μm and the thermal transfer material having an overall thickness of 2.5 to 7.0 μm.

In an embodiment of the foregoing thermal transfer material, the yellow heat-meltable ink layer, the magenta heat-meltable ink layer and the cyan heat-meltable ink layer are disposed in a side-by-side relationship on a single foundation.

The present invention further provides an assembly of plural thermal transfer materials, comprising a first thermal transfer material comprising a foundation and a yellow heat-meltable ink layer provided the foundation, a second thermal transfer material comprising a foundation and a magenta heat-meltable ink layer provided on the foundation, and a third thermal transfer material comprising a foundation and a cyan heat-meltable ink layer provided on the foundation, each ink layer having a melt viscosity of 20 to 200 cps/90° C. and a coating amount of 0.5 to 2.5 g/m$^2$, each foundation having a thickness of 1.0 to 4.5 μm and each thermal transfer material having an overall thickness of 2.5 to 7.0 μm.

DETAILED DESCRIPTION

Figure 1:
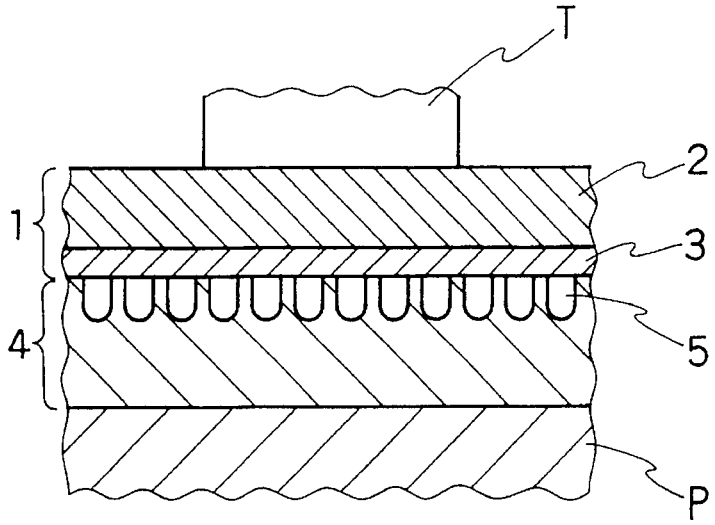
FIG. 1 is a schematic sectional view showing a color image formation method using a thermal transfer material in accordance with the present invention.
Figure 2:
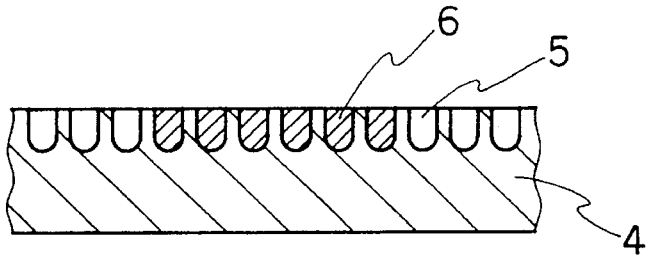
FIG. 2 is a partial sectional view showing a porous surface receptor wherein a color image is formed according to the foregoing color image formation method.
Figure 3:
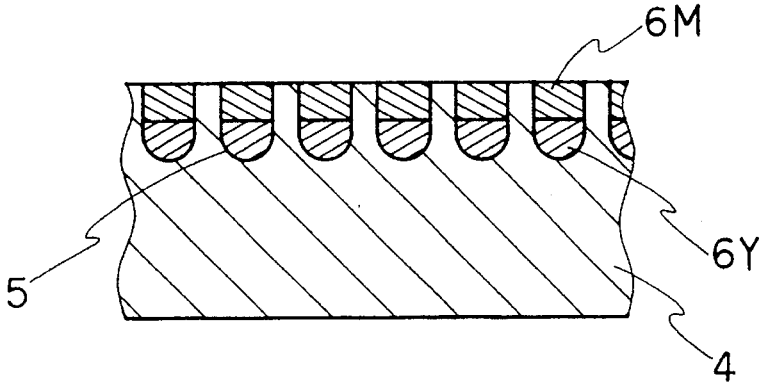
FIG. 3 is a partial sectional view showing a porous surface receptor wherein a color image composed of a yellow ink layer and a magenta ink layer superimposed one on another is formed.

In the present invention, each of the heat-meltable ink layers for respective colors is specified to have a melt viscosity within the range of 20 to 200 cps/90° C., thereby ensuring the entrance of each ink into the micropores of the receptor.

Further, the coating amount of each of the heat-meltable ink layers for respective colors is specified to a range of 0.5 to 2.5 g/m$^2$, the thickness of the foundation is specified to a range of 1.0 to 4.5 μm, and the overall thickness of the thermal transfer material is specified to a range of 2.5 to 7.0 μm. By virtue of such features, the heat energy from a heating element is prevented from spreading along the plane of the thermal transfer material as fully as possible, so that the ink can be transferred in an area as near to the area of the heating element as possible.

Moreover, mainly by virtue of the specified melt viscosity and coating amount of each ink layer, the whole amount of the ink which is melted to be liquid by the heat energy from the heating element can be entered into all micropores present in an area of the receptor which corresponds to the heating element.

According to the present invention, a predetermined amount of each ink is sure to enter the micropores present in an area of the receptor which corresponds to the heating element and undesirable phenomena such as excess transfer do not occur. Accordingly, an excellent gradation and a desired subtractive color mixture are achieved, thereby giving a color image, particularly a multi-color or full-color image excellent in both color reproducibility and resolution.

When the melt viscosity of each of the ink layers for respective colors is higher than 200 cps/90° C., it is difficult for the ink to enter the micropores, resulting in the excess transfer. When the melt viscosity is lower than 20 cps/90° C., the ink spreads so that picture elements are jointed to each other, resulting in a decrease of resolution.

When the coating amount (on dry weight basis) of each of the ink layers for respective colors is more than 2.5 g/m$^2$, the excess transfer is prone to occur. When the coating amount is less than 0.5 g/m$^2$, the density of each color is insufficient.

When the thickness of the foundation and that of the thermal transfer material are larger than 4.5 μm and 7.0 μm, respectively, the resolution decreases. When the thickness of the foundation and that of the thermal transfer material are less than 1.0 μm and 2.5 μm, respectively, the thermal transfer material lacks strength as an ink ribbon, and the density of each color is insufficient due to the restricted coating amount of each ink layer.

The present invention will be explained in detail.

The heat-meltable ink layers for respective colors are each composed of a coloring agent and a heat-meltable vehicle. The heat-meltable vehicle is composed predominantly of a wax and optionally a heat-meltable resin.

Examples of specific waxes include natural waxes such as haze wax, bees wax, lanolin, carnauba wax, candelilla wax, montan wax and ceresinc wax; petroleum waxes such as paraffin wax and microcrystalline wax; synthetic waxes such as oxidized wax, ester wax, low molecular weight polyethylene wax and Fischer-Tropsch wax; higher fatty acids such as laurie acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and besamides such as oleic acid amide. These waxes may be used either alone or in combination.

Examples of specific heat-meltable resins include ethylene copolymers such as ethylene-vinyl acetate copolymer, ethylene-vinyl butyrate copolymer, ethylene(meth)acrylic acid copolymer, ethylene-alkyl (meth)acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethylene-acrylonitrile copolymer, ethylene-acrylamide copolymer, ethylene-N-methylolacrylamide copolymer and ethylene-styrene copolymer; poly(meth)acrylic acid esters such as polylauryl methacrylate and polyhexyl acrylate; vinyl chloride polymer and copolymers such as polyvinyl chloride, vinyl chloride-vinyl acetate copolymer and vinyl chloride-vinyl alcohol copolymer; polyesters, polyamides, cellulose resins, natural rubber, styrene-butadiene copolymer, isoprene polymer, chloroprene polymer, petroleum resins, rosin resins, terpene resins and cumarone-indene resins. These resins may be used either alone or in combination.

The coloring agents for yellow, magenta and cyan for the ink layers are preferably transparent ones.

Examples of specific transparent coloring agents for yellow include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake; and dyes such as Auramine. These coloring agents may be used either alone or in combination.

Examples of specific transparent coloring agents for magenta include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake; and dyes such as Rhodamine. These coloring agents may be used either alone or in combination.

Examples of specific transparent coloring agents for cyan include organic pigments such as Victoria Blue Lake, metal-free Phthalocyanine Blue, Phthalocyanine Blue and Fast Sky Blue; and dyes such as such as Victoria Blue. These coloring agents may be used either alone or in combination.

The term "transparent pigment" is herein meant by a pigment which gives a transparent ink when dispersed in a transparent vehicle.

If the superimposing of the three colors, yellow, magenta and cyan, can hardly give a clear black color, there may be further used a black ink layer containing a coloring agent for black such as carbon black, Nigrosine Base or the like. The black ink layer for this purpose is not adapted for the superimposing with other color ink layer and, hence, need not be necessarily transparent. Nevertheless, the black ink layer is preferably transparent for the purpose of giving a desired color such as blue black by the superimposing with other color ink layer.

The content of the coloring agent in the heat-meltable ink layer for each color is preferably about 5 to about 60% by weight.

The heat-meltable ink layer may be incorporated, in addition to the above ingredients, with a dispersant, an antistatic agent and other additives, as required.

The melting point of the heat-meltable ink layer is preferably from about 60° to about 85° C. When the melting point is lower than 60° C., the storage property of the thermal transfer material is prone to degrade. When the melting point is higher than 85° C., the transfer sensitivity is prone to degrade.

The thermal transfer material of the present invention is one wherein the heat-meltable ink layers for respective colors are provided on a foundation or foundations. The yellow ink layer, the magenta ink layer and the cyan ink layer and optionally the black ink layer may be disposed either on separate foundations, respectively, or on a single foundation in a side-by-side relationship.

Figure 4:
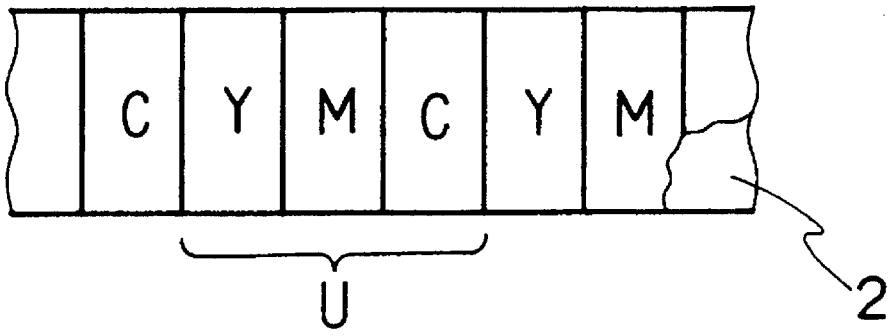
FIG. 4 is a partial plan view showing an example of an arrangement of ink layers for respective colors in a thermal transfer material in accordance with the present invention.
Figure 5:
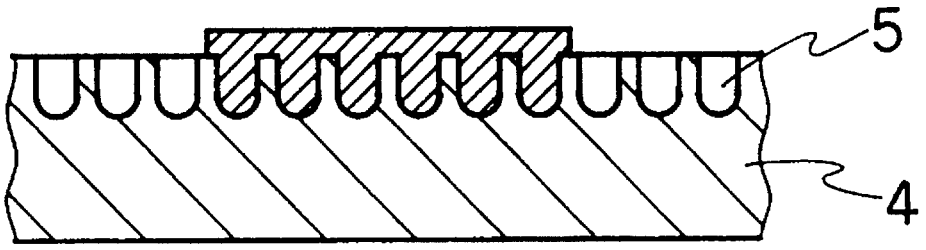
FIG. 5 is a sectional view illustrating an excess transfer phenomenon.

FIG. 4 illustrates an example of a thermal transfer material wherein the ink layers for respective colors are disposed on a single foundation in a side-by-side relationship. In FIG. 4, a yellow ink layer Y, a magenta ink layer M and a cyan ink layer C, each of which preferably has a predetermined constant size, are periodically repeatedly disposed in a side-by-side relationship on a continuous foundation 2 in a repeating unit U comprising the ink layers Y, M and C arranged in a predetermined order. The order of arrangement of these three color ink layers in the repeating unit U can be determined as desired. A black ink layer may be included in the repeating unit U.

Alternatively the yellow ink layer, the magenta ink layer and the cyan ink layer and optionally the black ink layer may be disposed in a side-by-side relationship on a single foundation in a stripe form along the longitudinal direction of the foundation.

Usable as the foundation are polyester films such as polyethylene terephthalate film, polyethylene naphthalate film and polyarylate film, polycarbonate films, polyamide films, aramid films and other various plastic films commonly used for the foundation of ink ribbons of this type. Thin paper sheets of high density such as condenser paper can also be used.

On the back side (the side adapted to come into slide contact with a thermal head) of the foundation may be formed a conventionally known stick-preventive layer. Examples of the material for the stick-preventive layer include various heat-resistant resins such as silicone resin, fluorine-containing resin and nitrocellulose resin, and other resins modified with these heat-resistant resins such as silicone-modified urethane resins and silicone-modified acrylic resins, and mixtures of the foregoing heat-resistant resins and lubricating agents.

The formation of a color image by use of the thermal transfer material of the present invention is preferably performed as follows: With use of a thermal transfer printer, the yellow ink layer, the magenta ink layer and the cyan ink layer are selectively melt-transferred onto a porous surface receptor in a predetermined order according to separation color signals of an original color image, i.e. yellow signals, magenta signals and cyan signals to enter the inks into the micropores of the receptor. The order of transfer of the yellow ink layer, the magenta ink layer and the cyan ink layer can be determined as desired. When a usual full-color or multi-color image is formed, all the three color ink layers are selectively transferred according to three color signals. When only one color signal or two color signals are present, the corresponding one or two of the three color ink layers are selectively transferred.

Thus there is obtained a color image comprising (1) at least one region of single color of yellow, magenta and cyan wherein different colors are not superimposed, or (2) at least one color region wherein a color is developed on the basis of subtractive color mixture of at least two of yellow, magenta and cyan, or (3) a combination of the color region (1) and the color region (2). Herein a region where the yellow ink and the magenta ink are superimposed in the micropores develops a red color; a region where the yellow ink and the cyan ink are superimposed in the micropores develops a green color; a region where the magenta ink and the cyan ink are superimposed in the micropores develops a blue color; and a region where the yellow ink, the magenta ink and the cyan ink are superimposed in the micropores develops a black color. A region where only the yellow ink, the magenta ink or the cyan ink is present in the micropores develops a yellow color, a magenta color or a cyan color.

In the above manner, a black color is obtained by the superimposing of the yellow ink, the magenta ink and the cyan ink. However, a black color may be obtained by using only the black ink.

Gradation colors for each color can be obtained by controlling the amount of each color ink transferred so that the amount of each color ink entering the micropores is adjusted.

Usable as the porous surface receptor is one disclosed in Japanese Unexamined Patent Publication No. 41287/1990. The porous surface receptor is prepared as follows: Two or more kinds of resins which are immiscible or less miscible with each other (for example, a combination of a homopolymer or copolymer of vinyl chloride and a homopolymer or copolymer of acrylonitrile) are dissolved into a solvent. The solution is applied onto a film substrate such as polypropylene film or polyester film. The resultant is passed through a liquid which is miscible with the solvent and incapable of dissolving the resins, thereby coagulating the resins, followed by drying. Thus a porous resinous layer is formed on the film substrate. The porous resinous layer is brought into contact with a smooth sheet material which is incompatible with the porous resinous layer and subjected to a heating treatment under a pressure to give a receptor having a porous surface layer containing a multiplicity of micropores.

The porous surface layer preferably has an average pore diameter of 0.1 to 10 μm, especially 0.5 to 5 μm, an average pore depth of 0.5 to 15 μm, especially 2 to 10 μm, and an average pore density of $5\times10^5$ to $1\times10^7/mm^2$.

The present invention will be more fully described by way of Examples. It is to be understood that the present invention is not limited to the Examples, and various change and modifications may be made in the invention without departing from the spirit and scope thereof.

EXAMPLE 1

Onto one side of a 3.5 μm-thick polyethylene terephthalate film which was provided on the other side thereof with a 0.1 μm-thick stick-preventing layer composed of a silicone-modified urethane resin were applied the inks for respective colors each having the composition shown in Table 1 by hot-melt coating to give a thermal transfer material wherein the ink layers for respective colors were arranged as shown in FIG. 4. The overall thickness of the thermal transfer material was 5.1 μm.

EXAMPLE 2

The same procedures as in Example 1 except that the compositions of the inks were changed to those shown in Table 2 were repeated to give a thermal transfer material.

COMPARATIVE EXAMPLE 1

The same procedures as in Example 1 except that the compositions of the inks were changed to those shown in Table 3 were repeated to give a thermal transfer material.

COMPARATIVE EXAMPLE 2

The same procedures as in Example 1 except that the compositions of the inks were changed to those shown in Table 4 were repeated to give a thermal transfer material.

COMPARATIVE EXAMPLE 3

The same procedures as in Example 1 except that the coating amount of each ink layer was changed to 3.0 g/m$^2$ were repeated to give a thermal transfer material having an overall thickness of 6.6 μm.

COMPARATIVE EXAMPLE 4

The same procedures as in Example 1 except that the thickness of the foundation film was changed to 6.0 μm were repeated to give a thermal transfer material having an overall thickness of 7.6 μm.

TABLE 1

| | Yellow ink layer | Magenta ink layer | Cyan ink layer |
|---|---|---|---|
| Formula (parts by weight) | | | |
| Paraffin wax | 60 | 60 | 60 |
| Carnauba wax | 20 | 20 | 20 |
| Ethylene-vinyl acetate copolymer | 5 | 5 | 5 |
| Pigment Yellow | 15 | — | — |
| Carmine 6B | — | 15 | — |
| Cyanine Blue KRO | — | — | 15 |
| Coating amount (g/m$^2$) | 1.5 | 1.5 | 1.5 |
| Melting point (°C.) | 72 | 72 | 72 |
| Melt viscosity (cps/90° C.) | 140 | 140 | 140 |

TABLE 2

| | Yellow ink layer | Magenta ink layer | Cyan ink layer |
|---|---|---|---|
| Formula (parts by weight) | | | |
| Paraffin wax | 64 | 64 | 64 |
| Carnauba wax | 20 | 20 | 20 |
| Ethylene-vinyl acetate copolymer | 1 | 1 | 1 |
| Pigment Yellow | 15 | — | — |
| Carmine 6B | — | 15 | — |
| Cyanine Blue KRO | — | — | 15 |
| Coating amount (g/m$^2$) | 1.5 | 1.5 | 1.5 |
| Melting point (°C.) | | | |
| Melt viscosity (cps/90° C.) | 26 | 23 | 24 |

TABLE 3

| | Yellow ink layer | Magenta ink layer | Cyan ink layer |
|---|---|---|---|
| Formula (parts by weight) | | | |
| Paraffin wax | 50 | 50 | 50 |
| Carnuaba wax | 22 | 22 | 22 |
| Ethylene-vinyl acetate copolymer | 13 | 13 | 13 |
| Pigment Yellow | 15 | — | — |
| Carmine 6B | — | 15 | — |
| Cyanine Blue KRO | — | — | 15 |
| Coating amount (g/m$^2$) | 1.5 | 1.5 | 1.5 |
| Melting point (°C.) | 72 | 72 | 72 |
| Melt viscosity (cps/90° C.) | 210 | 230 | 215 |

TABLE 4

| | Yellow ink layer | Magenta ink layer | Cyan ink layer |
|---|---|---|---|
| Formula (parts by weight) | | | |
| Paraffin wax | 80 | 80 | 80 |
| Carnuaba wax | 5 | 5 | 5 |
| Pigment Yellow | 15 | — | — |
| Carmine 6B | — | 15 | — |
| Cyanine Blue KRO | — | — | 15 |
| Coating amount (g/m$^2$) | 1.5 | 1.5 | 1.5 |
| Melting point (°C.) | 72 | 72 | 72 |
| Melt viscosity (cps/90° C.) | 17 | 16 | 15 |

With use of each of the thus obtained thermal transfer materials in a thermal transfer printer specified below, printing was conducted on a porous surface receptor specified below to evaluate gradation and resolution.

Thermal transfer printer: TRUEPRINT 2200 made by Victor Company of Japan, Limited, thermal head: 300 dots/inch Porous surface receptor: SPU-145XEW made by NISSHINBO INDUSTRIES, INC., average pore diameter: 2.5 μm average pore depth: 10 μm average pore density: $6\times10^5$ mm$^2$

(1) Gradation

Figure 6:
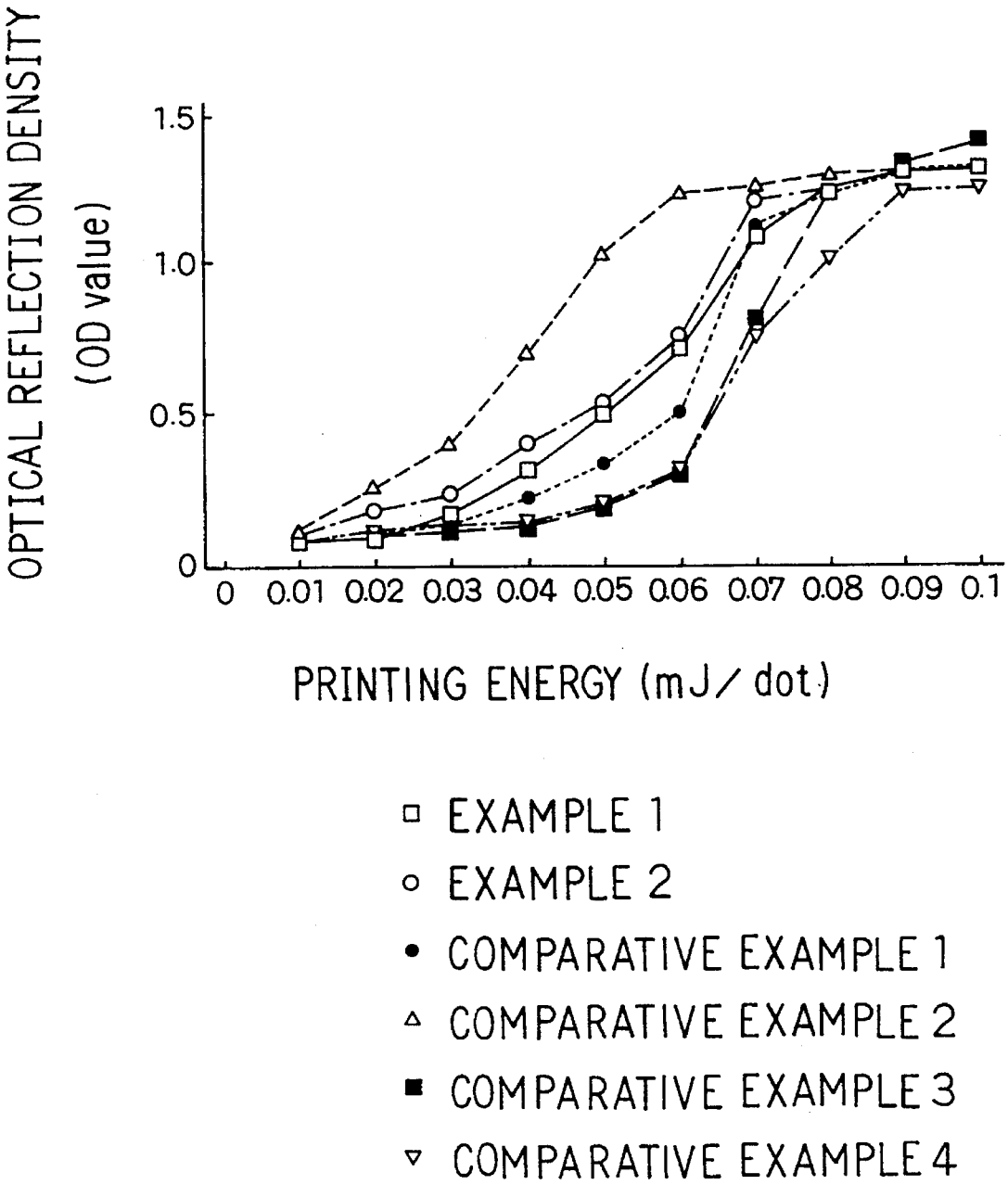
FIG. 6 is a graph showing a relationship between printing energy and optical reflection density with respect to the images obtained by using the thermal transfer materials of Examples 1 to 2 and Comparative Examples 1 to 4.

One-dot printing was conducted while increasing the printing energy by 0.01 mJ/dot within the range of 0.01 to 0.1 mJ/dot. The optical reflection density (OD value) of the thus obtained images was measured and a relationship between the printing energy and the optical reflection density was determined. The results are shown in FIG. 6. Each curve of the graph shown in FIG. 6 was obtained by plotting an average value of the respective values for the yellow, magenta and cyan images. The nearer to a straight line the curve is, the better the gradation is.

(2) Resolution

One dot-line was printed every other one dot-line at a printing speed of one inch/second and a printing energy of 0.1 mJ/dot and the width of the obtained one-dot line was determined. The results are shown in Table 5. Each value shown in Table 5 is an average value of the respective values for the yellow, magenta and cyan lines. The nearer the line width is to the width (0.09 mm) of the line obtained on a heat-sensitive paper by printing under the same conditions as above, the better the resolution is.

TABLE 5

| | Ex. 1 | Ex. 2 | Com. Ex. 1 | Com. Ex. 2 | Com. Ex. 3 | Com. Ex. 4 |
|---|---|---|---|---|---|---|
| Line width (mm.) | 0.09 | 0.12 | 0.3 | 0.18 | 0.06 | 0.04 |

In addition to the materials and ingredients used in the Examples, other materials and ingredients can be used in the Examples as set forth in the specification to obtain substantially the same results.

As described above, in a method for forming a color image wherein yellow, magenta and cyan heat-meltable ink layers are selectively melt-transferred to a porous surface receptor to enter the respective color inks into the micropores thereof, thereby forming a color image on the basis of subtractive color mixture, the thermal transfer material of the present invention gives a color image excellent in both color reproducibility and resolution.

What is claimed is:

1. A thermal transfer system comprising a receptor having a multiplicity of micropores in the surface layer thereof and a thermal transfer material for use in a method for forming a color image comprising selectively melt-transferring at least one of a yellow heat-meltable ink layer, a magenta heat-meltable ink layer or a cyan heat-meltable ink layer onto said receptor, each ink entering into the micropores in a molten state, thereby forming a color image, said color image comprising at least one color region developed on the basis of subtractive color mixture of at least two of yellow, magenta and cyan, or a combination of said color region with at least one single color region of yellow, magenta or cyan, the thermal transfer material comprising a foundation and at least one of a yellow heat-meltable ink layer, a magenta heat-meltable ink layer and a cyan heat-meltable ink layer provided on the foundation, each ink layer having a melt viscosity of 20 to 200 cps/90° C. and a coating amount of 0.5 to 2.5 g/m$^2$, the foundation having a thickness of 1.0 to 4.5 μm and the thermal transfer material having an overall thickness of 2.5 to 7.0 μm.

2. The thermal transfer system of claim 1, wherein the yellow heat-meltable ink layer, the magenta heat-meltable ink layer and the cyan heat-meltable ink layer are disposed in a side-by-side relationship on the foundation.

3. The thermal transfer system of claim 2, wherein the yellow heat-meltable ink layer, the magenta heat-meltable ink layer and the cyan heat-meltable ink layer are periodically repeatedly disposed in a side-by-side relationship on the foundation in a repeating unit comprising the yellow, magenta and cyan heat-meltable ink layers arranged in a predetermined order.

4. A thermal transfer system comprising a receptor having a multiplicity of micropores in the surface layer thereof and an assembly of plural thermal transfer materials for use in a method for forming a color image comprising selectively melt-transferring at least one of a yellow heat-meltable ink layer, a magenta heat-meltable ink layer or a cyan heat-meltable ink layer onto sold receptor, each ink entering into the micropores in a molten state, thereby forming a color image, said color image comprising at least one color region developed on the basis of subtractive color mixture of at least two or yellow, magenta and cyan, or a combination of said color region with at least one single color region of yellow, magenta or cyan, the assembly comprising a first thermal transfer material comprising a first foundation and a yellow heat-meltable ink layer provided on said first foundation, a second thermal transfer material comprising a second foundation and a magenta heat-meltable ink layer provided on said second foundation, and a third thermal transfer material comprising a third foundation and a cyan heat-meltable ink layer provided on said third foundation, each ink having a melt viscosity of 20 to 200 cps/90° C. and a coating amount of 0.5 to 2.5 g/m$^2$, each foundation having a thickness of 1.0 to 4.5 μm and each thermal transfer material having an overall thickness of 2.5 to 7.0 μm.

5. A method for forming a color image, comprising the steps of:

providing a thermal transfer material comprising a foundation, and a yellow heat-meltable ink layer, a magenta heat-meltable ink layer and a cyan heat-meltable ink layer provided in a side-by-side relationship on the foundation, each ink layer having a melt viscosity of 20 to 200 cps/90° C. and a coating amount of 0.5 to 2.5 g/m$^2$, the foundation having a thickness of 1.0 to 4.5 μm and the thermal transfer material having an overall thickness of 2.5 to 7.0 μm, selectively melt-transferring at least two of the ink layers onto a receptor, said receptor having a multiplicity of micropores in the surface layer thereof and each ink entering into the micropores in a molten state, thereby forming a color image, said color image comprising at least one color region developed on the basis of subtractive color mixture of at least two of yellow, magenta and cyan, or a combination of said color region with at least one single color region of yellow, magenta or cyan.

6. The method of claim 5, wherein the surface layer of the receptor has an average pore diameter of 0.1 to 10 μm, an average pore depth of 0.5 to 15 μm and an average pore density of $5\times10^5$ to $1\times10^7$/mm$^2$.

7. A method for forming a color image, comprising the steps of:

providing an assembly comprising a first thermal transfer material comprising a first foundation and a yellow heat-meltable ink layer provided on said first foundation, a second thermal transfer material comprising a second foundation and a magenta heat-meltable ink layer provided on said second foundation and a third thermal transfer material comprising a third foundation and a cyan heat-meltable ink layer provided on said third foundation, each ink layer having a melt viscosity of 20 to 200 cps/90° C. and a coating amount of 0.5 to 2.5 g/m$^2$, each foundation having a thickness of 1.0 to 4.5 μm and each thermal transfer material having an overall thickness of 2.5 to 7.0 μm, selectively melt-transferring at least two of the ink layers onto a receptor, said receptor having a multiplicity of micropores in the surface layer thereof and each ink entering into the micropores in a molten state, thereby forming a color image, said color image comprising at least one color region developed on the basis of subtractive color mixture of at least two of yellow, magenta and cyan, or a combination of said color region with at least one single color region of yellow, magenta or cyan.

8. The method of claim 7, wherein the surface layer of the receptor has an average pore diameter of 0.1 to 10 μm, an average pore depth of 0.5 to 15 μm and an average pore density of $5\times10^5$ to $1\times10^7$/mm$^2$.

* * * * *